United States Patent [19]

Carthew et al.

[11] Patent Number: 4,764,108

[45] Date of Patent: Aug. 16, 1988

[54] MODULAR OVEN

[75] Inventors: Maximilian K. Carthew, Rochester Hills; Joseph D. Donahue, Troy, both of Mich.

[73] Assignee: Haden Schweitzer Corporation, Madison Heights, Mich.

[21] Appl. No.: 34,799

[22] Filed: Apr. 3, 1987

Related U.S. Application Data

[63] Continuation of Ser. No. 832,007, Feb. 24, 1986, abandoned.

[51] Int. Cl.[4] ..... F27B 9/02

[52] U.S. Cl. ..... 432/128; 432/247; 432/251; 432/3

[58] Field of Search ..... 432/247, 251, 3, 128, 432/164, 192; 110/336, 173 B, 332

[56] References Cited

U.S. PATENT DOCUMENTS

| | | | |
|---|---|---|---|
| 1,510,556 | 10/1924 | Owens | 432/128 |
| 1,577,487 | 3/1926 | Otto | 432/251 |
| 3,977,824 | 8/1976 | Korting et al. | 432/251 |
| 4,246,852 | 1/1981 | Werych | 432/247 |
| 4,249,888 | 2/1981 | Werych | 432/3 |
| 4,311,460 | 1/1982 | Laversdorf et al. | 432/251 |
| 4,334,862 | 6/1982 | Muckelrath | 432/128 |

*Primary Examiner*—Henry C. Yuen

*Attorney, Agent, or Firm*—Niro, Scavone, Haller, Niro & Rocky, Ltd.

[57] ABSTRACT

An oven construction in which an elongated oven assembly is provided by manufacturing a plurality of oven modules at a factory location and then shipping the modules to the usage site where they are assembled together in end-to-end fashion to form the final oven assembly. Each oven module includes an outer shell and an inner shell mounted so as to be spaced apart for insulation therebetween. The shells are interconnected at one point along the length thereof, but are allowed to expand differentially along the remainder of their lengths. The outer shell is rigidly tied to a foundation but the inner shell, through any of various approaches, is allowed to slide or move relative to the foundation everywhere except the one point where it is secured to the outer shell. Each module has a bellows-type expansion joint around the periphery of one end to allow for interconnection of the modules, one to another.

3 Claims, 5 Drawing Sheets

MODULAR OVEN

This is a continuation of co-pending application Ser. No. 832,007, filed on Feb. 24, 1986, now abandoned.

BACKGROUND OF THE INVENTION

This invention relates to ovens and more particularly to ovens for performing industrial functions such as drying paint and other coatings, curing laminates, and so forth.

Historically, industrial ovens have been built on site from oven panels which are a sandwich of sheet metal skins with insulation fill. These panels are typically joined together using an overlapping tongue and groove construction and the oven corner areas are sealed on an ad hoc basis using various clamping and gasketing methods.

This construction, while satisfactory in many operations, suffers from several disadvantages. Specifically, the construction method is labor-intensive since virtually all of the construction is performed on the site. Further, the resulting construction often suffers from relatively high heat loss due to leakage at seams. Further, this construction provides a structure which is difficult to clean because of the many irregularities in the interior surfaces, and further, because it allows cleaning water to seep into the insulation between the outer skins through the seams between the tongue and groove panels with consequent moisture problems, and derogation of the heat insulating capacity of the oven.

SUMMARY OF THE INVENTION

This invention is directed to the provision of an industrial oven which overcomes the disadvantages of the prior art ovens.

Specifically, this invention is directed to the provision of an industrial oven which is quickly and inexpensively erectable at the site by assembling modules in an end-to-end fashion; which has improved cleanability as compared to prior art ovens by virtue of a smooth, clean interior surface; and which precludes leakage of water, paint fumes or other substances into the insulation.

According to an important aspect of the present invention, the oven is built in modules at a factory location and the modules are shipped to the site for assembly to form the final oven. This allows factory control of the welding and assembly and results in a superior quality oven. This arrangement also reduces the labor cost significantly and results in a less expensive oven construction for a given oven capacity.

Each oven module comprises an outer longitudinally extending shell; an inner longitudinally extending shell positioned within the outer shell and substantially longitudinally coextensive with the outer shell; and means rigidly securing the inner shell to the outer shell at a predetermined interface location while allowing relative longitudinal movement between the shells along the remainder of the interface of the shells so that the inner shell may expand longitudinally from the connection point in response to heating of the oven.

According to a specific embodiment of the invention, the inner shell includes a rigid floor structure and the means securing the the inner shell to the outer shell is located at the longitudinal midsection of the floor.

According to a specific embodiment of the invention, the outer shell includes side rails forming the opposite lower longitudinal support for the outer shell; the floor structure of the inner shell includes a plurality of laterally extending cross rails at longitudinally spaced locations along the floor structure; and the inner shell is rigidly secured at its midsection to the midsection of the outer shell by rigidly securing the lateral ends of a central cross rail to the adjacent portions of the side rails of the outer shell.

According to the specific embodiment of the invention, other cross rails of the floor structure of the inner shell are secured to the adjacent portions of the side rails of the outer shell with a lost motion connection to allow movement of these cross rails relative to the outer shell.

In one specific embodiment of the invention, the lost motion connection between the cross rails of the inner shell and the side rails of the outer shell includes bolts projecting rigidly and laterally from the lateral ends of the cross rails for sliding receipt in longitudinally extending slots in the adjacent portions of the side rails of the outer shell so that the cross rails may be rigidly secured to the side rails by nuts engaging the bolts for secure shipment whereafter the nuts may be loosened to allow movement of the cross rails relative to the outer shell during use of the module in a drying oven environment.

In another specific embodiment, the floor of the inner shell is secured to cross beams at spaced intervals and these beams are allowed to slide on longitudinal rails to accommodate thermal expansion.

According to a further aspect of the invention, the oven comprises a plurality of longitudinally extending oven modules positioned in end-to-end relation to comprise an elongated continuous oven with each module including an outer longitudinally extending shell, an inner longitudinally extending shell positioned within the outer shell and substantially longitudinally coextensive with the outer shell, and means securing the inner shell to the outer shell at the interface of the longitudinal midsections of the shells while allowing relative longitudinal movement between the shells along the remainder of the interface of the shells so that the inner shell may expand outwardly from its midsection in response to heating of the oven. An expansion joint interconnects the ends of the inner shell of each module to the adjacent end of the inner shell of the adjacent module to allow the adjacent inner shell ends to freely expand and retract relative to each other in response to heating of the oven.

According to a further feature of the invention, each inner shell of each module is tubular and defines a sealed longitudinally extending chamber and each expansion joint is annular and extends sealingly around the entire annular interface between adjacent ends of the adjacent inner shells to allow expansion between the adjacent ends while providing a continuous elongated sealed chamber extending the entire length of the oven.

According to a further feature of the invention, an oven is provided in which a plurality of tubular inner modules are positioned end-to-end within an outer shell assembly with insulative space between the confronting surfaces of the inner module and the outer shell; insulative material is positioned within the insulative space which substantially fills the space but allows relative longitudinal movement between the tubular modules and the outer shells; the tubular modules are mounted within the outer shell assembly for longitudinal movement relative to the outer shell assembly to allow the inner shell assembly to expand longitudinally in response to the heating of the oven; and expansion joint means are provided at the adjacent ends of the tubular modules which sealingly but expansably interconnect the adjacent ends to provide a sealed, longitudinally extending inner chamber while allowing relative movement between the modules as the inner shell assembly expands within the outer shell assembly.

DETAILED DESCRIPTION OF THE PREFERRED EMBODIMENT

Figure 1:
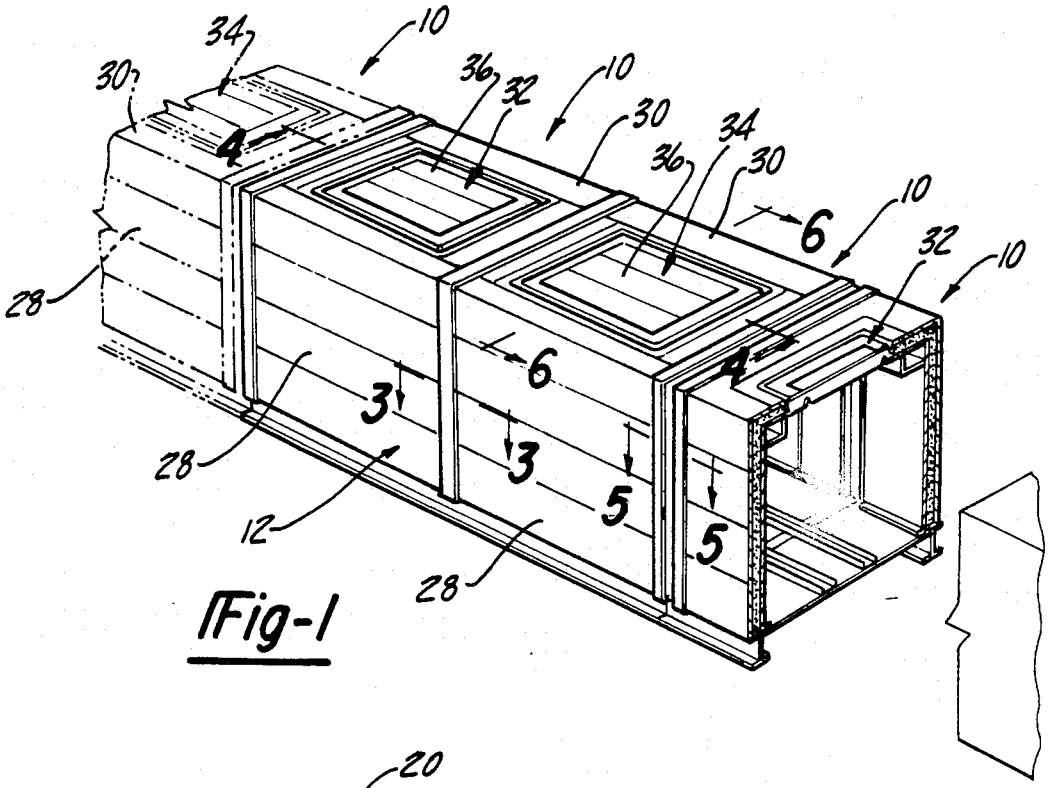
FIG. 1 is fragmentary perspective view of an oven assembly according to the invention.
Figure 2:
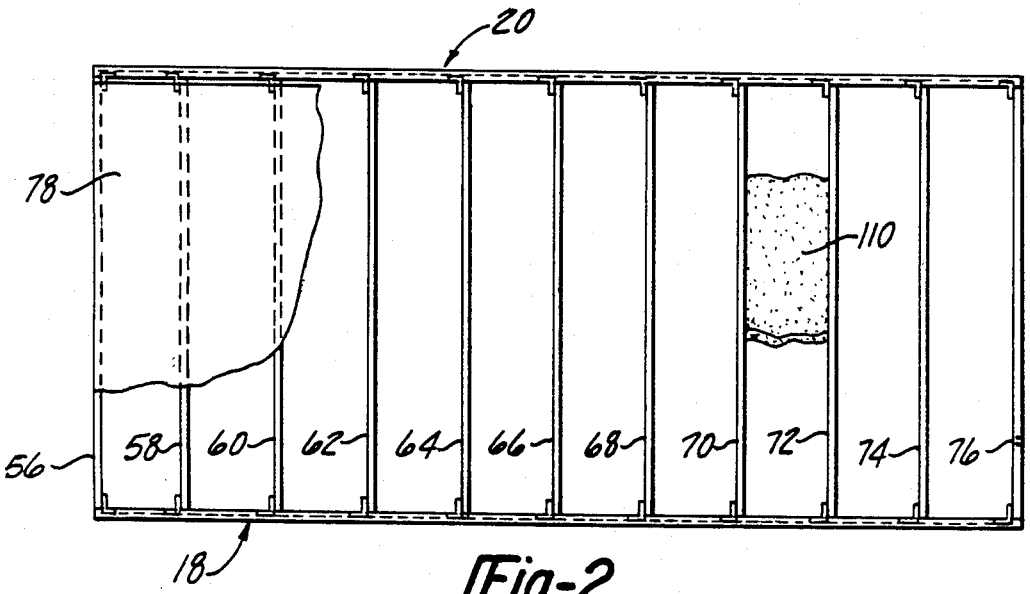
FIG. 2 is a plan view of the floor structure of an oven module employed in the oven assembly of FIG. 1.
Figure 3:
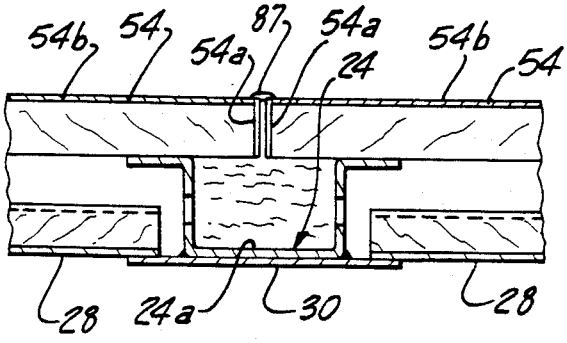
FIG. 3, 4, 5, and 6 are cross sectional views taken respectively on lines 3—3, 4—4, 5—5, and 6—6 of FIG. 1.
Figure 4:
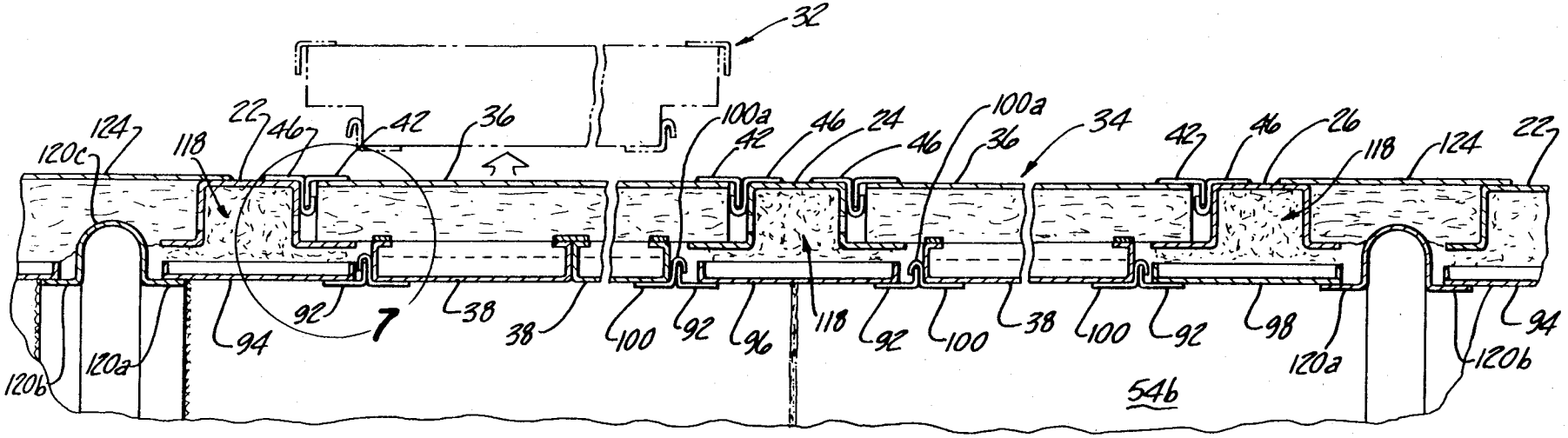
Figure 7:
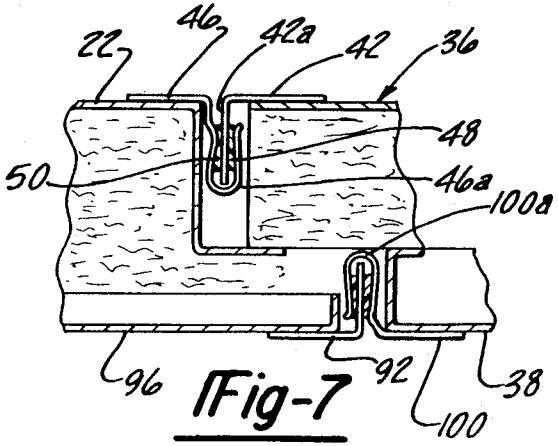
FIG. 7 is an enlarged view of a portion of the oven construction seen in circle 7 of FIG. 4.
Figure 5:
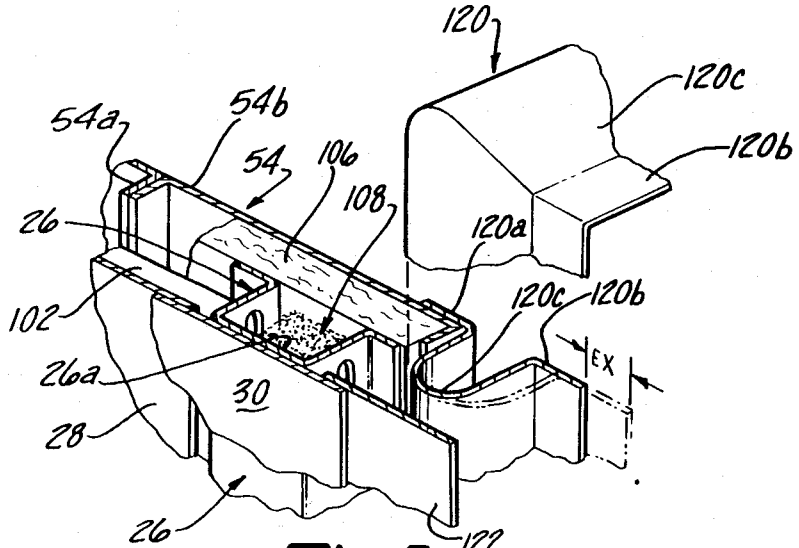
Figure 6:
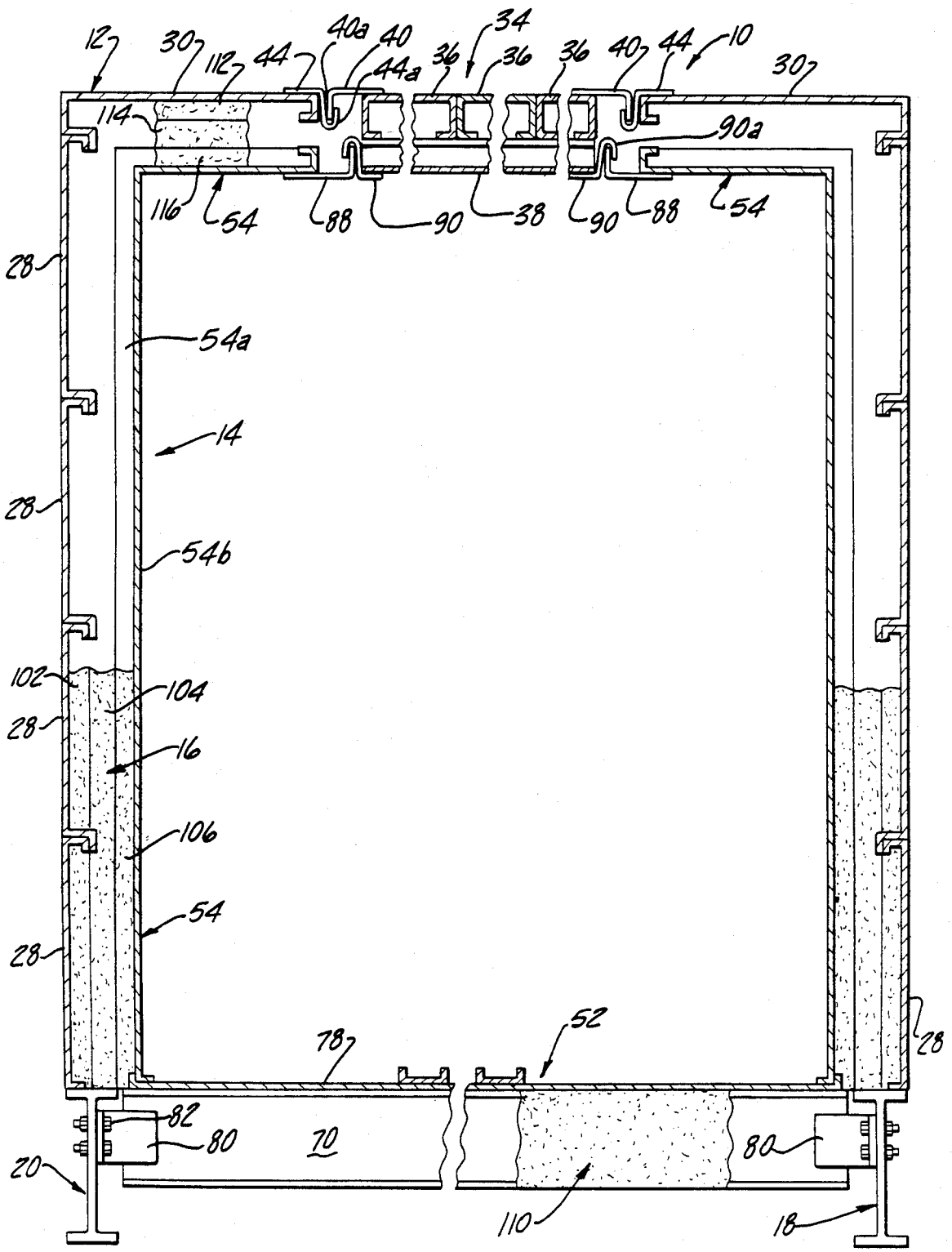

The illustrative oven is formed by placing a plurality of oven modules 10 in end-to-end relation to form a final continuous oven having a length corresponding to the aggregate length of the individual modules. For example, each module 10 may have a length of 25 feet so that the final oven has a total length in feet that is the sum of the number of modules multiplied by 25. Four modules are shown in FIG. 1 disposed end-to-end, with the left hand module shown fragmentarily and in phantom, the center two modules shown solid and complete, and the righthand module shown fragmentarily and in cross section to reveal details of the inner construction.

Each module 10, broadly considered, includes an outer shell assembly 12; an inner shell assembly 14; and insulative means 16 interposed between the inner and outer shells. The shells may be made of various materials such as steel, galvanized or aluminized steel, stainless steel, and various coated or plated metals.

Outer shell assembly 12 includes a pair of side rails 18 and 20 forming the opposite lower longitudinal edges of the shell; strong back structures 22, 24, and 26 positioned at the midsection of the shell and at each end of the shell; and panels 28 extending longitudinally between the strong back structures.

Side rails 18 and 20 have an I configuration and extend the full length of the oven module.

Strong back structures 22, 24, and 26 have a hat-shaped cross sectional configuration and extend in a U form upwardly along one side of the module, transversely across the top of the module, and then downwardly along the other side of the module. Each strong back structure is rigidly secured by welding at its lower ends to the respective upper faces of side rails 18 and 20.

Panels 28 have a generally U-shaped cross sectional configuration and extend longitudinally between the strong back structures with their opposite ends weldingly secured to the inner faces of flashing plates 30 weldingly secured to the outer face of the central or web portion 22*a*, 24*a*, and 26*a* of the respective strong back structure. Panels 28 are stacked one on top of each other in nesting configuration and are welded together continuously along their adjacent seams and along the seam formed between the lower panel 28 and the side rails 18 and 20 to form smooth continuous side walls for the outer shell.

The roof of the outer shell is formed by panels 30 nesting at their outer edges on the top edge of the topmost side panel 28 and extending longtudinally between the strong back structures and weldingly secured thereto. The roof of the outer shell is further formed by a pair of explosion panels 32 and 34 positioned between roof panels 30 and between the strong back structures 22, 24, and 26.

Each explosion panel 32,34 is a composite structure formed of a plurality of longitudinally extending U-shaped panels 36 positioned on top of a plurality of transversely extending U-shaped panels 38 with the panels welded in a continuous manner to form a continuous composite structure. Flashing strips 40 and 42 comprise outer connecting elements of roof panels 32, 34. Flashing strips 40 are secured along the longitudinal edges of explosion panels 32,34 and flashing strips 42 are secured along the lateral edges of explosion panels 32,34. Flashing strips 44 and 46 comprise outer fastening elements of modules 10. Further flashing strips 44 are secured along the longitudinal inboard edges of roof panels 30 and further flashing strips 46 are secured along the inboard lateral edges of strong back structures 22 and 26 and along both lateral edges of central strong back 24. Flashing strips 44 and 46 include upwardly opening U-shaped trough portions 44*a*,46*a* and gasket material 50 is positioned in troughs 44*a*,46*a*. Flashing strips 40 and 42 include downturned outboard end portions 40*a*,42*a* which are sealingly received in the gasket material 50 positioned respectively in trough portions 44*a*,46*a* to position explosion panels 32 and 34 firmly and sealingly within the roof structure of the outer shell of the oven module.

Inner shell 14 includes a floor structure 52 and a plurality of panels 54.

Figure 8:
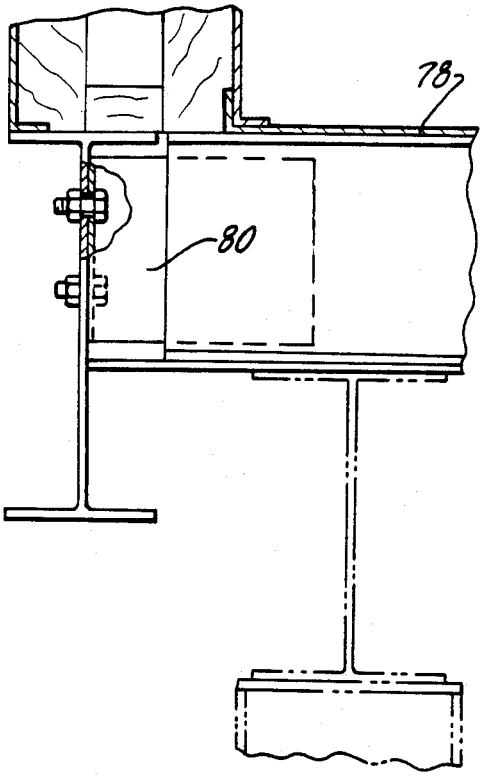
FIG. 8 is a fragmentary cross sectional view showing a lost motion connection employed between the inner and outer shell of the invention oven module.
Figure 9:
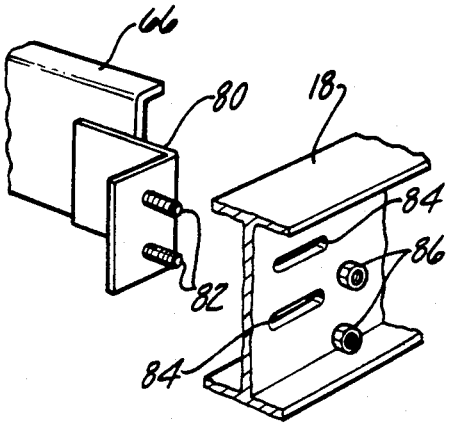
FIG. 9 is a fragmentary perspective view showing further details of the manner in which the inner and outer shells of the invention oven module are interconnected.

Floor structure 52 includes a plurality of longitudinally spaced cross beams 56–76 of channel configuration and a floor plate 78 overlying cross beams 56–76. Cross beams 56–76 extend laterally between the side rails 18 and 20 of the outer shell structure. Floor plate 78 is rigidly welded to central cross beam 66 but is not welded or otherwise secured to any of the other cross beams. Angle brackets 80 are welded to the lateral ends of each of the cross beams. The angle brackets 80 secured to the lateral ends of central beam 66 are fixedly welded to the adjacent face of side rails 18 and 20 and the angle brackets 80 associated with the other cross beams are connected to side rails 18 and 20 by a lost motion connection best seen in FIGS. 8 and 9. Each lost motion connection comprises a pair of bolts 82 welded to the associated angle bracket 80 and projecting laterally therefrom for passage through longitudinally extending slots 84 in the adjacent portion of the side rail 18,20 so that the associated cross member may be rigidly secured to the side rails 18,20 by tightening of nuts 86 or may be allowed to slide longitudinally relative to the side rails by loosening nuts 86.

Panels 54 are arranged in upstanding side-by-side relation along the longitudinal edges of floor structure 52. Each panel 54 has a U-shaped configuration with the edge flanges 54*a* of the panels abutting in the assembled relation of the panels and the main body portions 54*b* of the panels presenting a flush smooth interior surface for the oven. Panels 54 are continuously welded at their lower edges to floor plate 78 and continuously welded, as seen at 87, along the interface of edge flanges 54*a* to form smooth, sealed continuous walls within the oven.

The roof of inner shell 14 is provided by inward integral extensions of side panels 54 and by the inner structures of explosion panels 32 and 34. Explosion panels 32 and 34 are sealingly received in inner shell 14 in a manner similar to their receipt in outer shell 12. Thus, flashing strips 88 extending along the longitudinal inner edges of panels 54 coact with gasket material 50 received within the trough portion 90*a* of flashing strips 90 secured to the inner longitudinal edges of explosion panels 32,34 and flashing strips 92, secured to flashing panels 94, 96, and 98 extending transversely of the inner shell beneath the roof portions of strong backs 22, 24, and 26 are received in the trough portions 100*a* of flashing strips 100 secured to the lateral inner edges of explosion panels 32,34. Thus, upstanding flashing strips 90 and 100 comprise inner connecting elements of roof panels 32, 34; whereas, upstanding flashing strips 88 and 92 comprise inner fastening elements of modules 10. Flashing panels 94, 96, and 98 are suitably secured, as by welding, to the roof portions of the respective strong back structures.

Insulation 16 generally fills the spaces between the outer surfaces of inner shell 14 and the inner surfaces of outer 12. Specifically, insulation 16 in the side walls of the oven module includes three layers of bat-type insulation 102, 104, and 106 which together form a laminar construction filling the space between the inner and outer shells. Loose insulation 108 fills the interior of the side portions of strong back structures 22, 24, and 26 to complete the insulation of the side walls.

The insulation of the floor of the oven module is accomplished by rigid insulation panels 110 positioned between cross beams 56–76 and totally filling the space between the cross beams so as to form a total and continuous blanket of insulation beneath floor plate 78.

The insulation in the roof of the oven module comprises batting layers 112, 114, and 116 interposed between the roof panels 30 and the inwardly directed portions of inner panels 54; suitable batting positioned within the channels 36 and 38 of explosion panels 32 and 34; and loose insulation 118 filling the hollows of the roof portions of strong structures 22, 14, and 26 and the areas defined between the strong back structures and the flashing members 94, 96, and 98.

In use, each oven module 10 is assembled at a factory location under strict material and quality control standards. The modules are then shipped to the site location where they are assembled together with a minimum of onsite labor and materials to form the final elongated oven assembly. Specifically, each oven module, as it is constructed at the factory, includes a complete outer shell assembly 12 and a complete inner shell assembly 14 positioned nestingly within outer shell assembly 12 with insulative material totally filling the spaces within the shells and with the central cross beam 66 of the floor structure of the inner shell assembly rigidly secured at its lateral ends to the side rails of the outer shell and the other cross beams of the floor structure secured at their lateral ends to the side rails of the outer shell by the lost motion connections comprising bolts 82 and slots 84. During shipment of the modules to the site, nuts 86 are tightened on bolts 82 to prevent damage to the oven module during shipment. The factory module also includes an expansion flashing at one end of the module in the form of an annular bellows 120. Bellows 120 includes flange portions 120*a* and 120*b* and a central expansion or bellows portion 120*c*. At the factory flange portion 120*a*, for example, is weldingly and sealingly secured to one end of the inner shell assembly. Specifically, flange portion 120*a* is weldingly secured along its vertical edges to the inner face of the end inner panel 54; is secured along its upper or roof portion to the inner surface of flashing 98; and is secured along its lower portion to floor plate 78.

Once the factory assembled modules arrive at the site, they are positioned in end-to-end relation to form the total elongated oven assembly, the free flange 120*b* at each expansion bellows is suitably weldably secured to the adjacent end of the inner shell of the adjacent module and further flashing material is positioned at the interfaces of the modules to complete the total assembly. Specifically, flange portion 120*b* of each annular bellows 120 is secured along its vertical edges to the end inner panels 54 of the adjacent oven modules; is secured along its roof portion to the inner surface of flashing 94 of the adjacent oven module; and is secured along its lower edge to the floor plate 78 of the adjacent module. The adjacent ends of the outer shell assemblies are then sealed by a flashing assembly comprising vertically extending flashing strip 122 positioned between flashing strips 30 and a roof flashing strip 124 suitably secured to the roof portion of the strong back 26 of one outer shell and the roof portion of the strong back 22 of the adjacent outer shell.

In the final assembled configuration of the oven bellows members 120 form continuous annular seals between adjacent oven modules and provide a continuous elongated sealed chamber extending the full length of the assembled modules.

In use, nuts 86 are loosened to allows bolts 82 to move freely in slots 84 so that cross beams 56–64 and 68–76 may move freely relative to the outer shell. As the oven becomes heated in use, the inner shell of each module may expand outwardly and longitudinally relative to the outer shell of that module from the fixed midsections of the inner and outer shells with the expansion being accommodated by flexing movement of the bellows portions 120*c* of the bellows 120. In the event of a buildup of excessive pressures within the oven, explosion panels 32 and 34 pop outwardly to relieve the excessive pressure within the oven.

The oven assembly of FIGS. 1–9 will be seen to provide many important advantages as compared to prior art oven assemblies. Specifically, since the construction lends itself to modular construction, a vast majority of the construction may be performed in a factory environment with skilled labor and strict quality control to ensure the formation of a quality and uniform product. Specifically, the oven modules are constructed with a high degree of precision and provide a continuous sealed inner chamber for the oven which is uninterrupted throughout the floor, sides or ceiling of the oven and which accordingly precludes the entry of water, fumes or paint into the area between the inner and outer shells of the oven. The smooth interior construction of the inner shell also facilitates cleaning of the oven since there are no nooks, crannies or crevices in which water can collect or which complicate the cleaning operation. In fact, the smooth interior surface of the invention oven module allows the total oven assemblies to be cleaned in a simple hosing operation.

Further, the described construction allows the modules to be assembled at a factory location and shipped without damage to the usage site and yet allows the individual module in use to expand to accommodate the severe heat of the oven. Specifically, the invention arrangement whereby the midsections of the inner and outer shells are rigidly joined but the end portions of the inner shells are allowed to move longitudinally with respect to each other enables the inner and outer shells to be rigidly secured together for shipment and then loosened at the usage site to allow the required expansion as between the various parts of the inner and outer shells.

The described construction also achieves a significant reduction in heat loss through the walls of the oven due to the superior quality control and the superior insulation construction and techniques made possible by the factory construction of the modules.

The described construction also, by virtue of performing the vast majority of work at the factory, enables rapid assembly of a completed oven and, specifically, allows a total oven assembly to be installed during factory shutdowns.

In summary, the described oven construction allows an oven of superior quality to be constructed and installed in less time and at less expense than prior art constructions.

Whereas a preferred embodiment of the invention has been illustrated and described in detail, it will be apparent that various changes may be made in the disclosed embodiement without departing from the scope or spirit of the invention. By way of example, the cross-sectional shape of the modules need not be square or rectangular, but may assume virtually any desired shape such as semi-circular, semi-elliptical, and so forth; further, the strongback structures 22,24,26 may not be needed in all embodiments; as an alternative, frames may be installed at the ends of the modules for shipping purposes, and may be removed at the time of assembly of the modules, one to another; further, the blow-off roof panels are optional and are not needed, for example, where the oven use does not involve combustible vapors or effluents; further, the panels 28 need not run horizontally, but could also be vertically arranged. Finally, it is not essential that the inner shell be secured to the cross beams and that the cross beams slide in the slots of the longitudinal beams. It is equally feasible, and within the scope of the present invention, to rigidly connect all of the beams, both longitudinal and lateral, to one another and allow the inner shell to slide longitudinally over both beams as it expands, the inner shell being fixed to a lateral beam at some predetermined point such as the middle.

Figure 10:
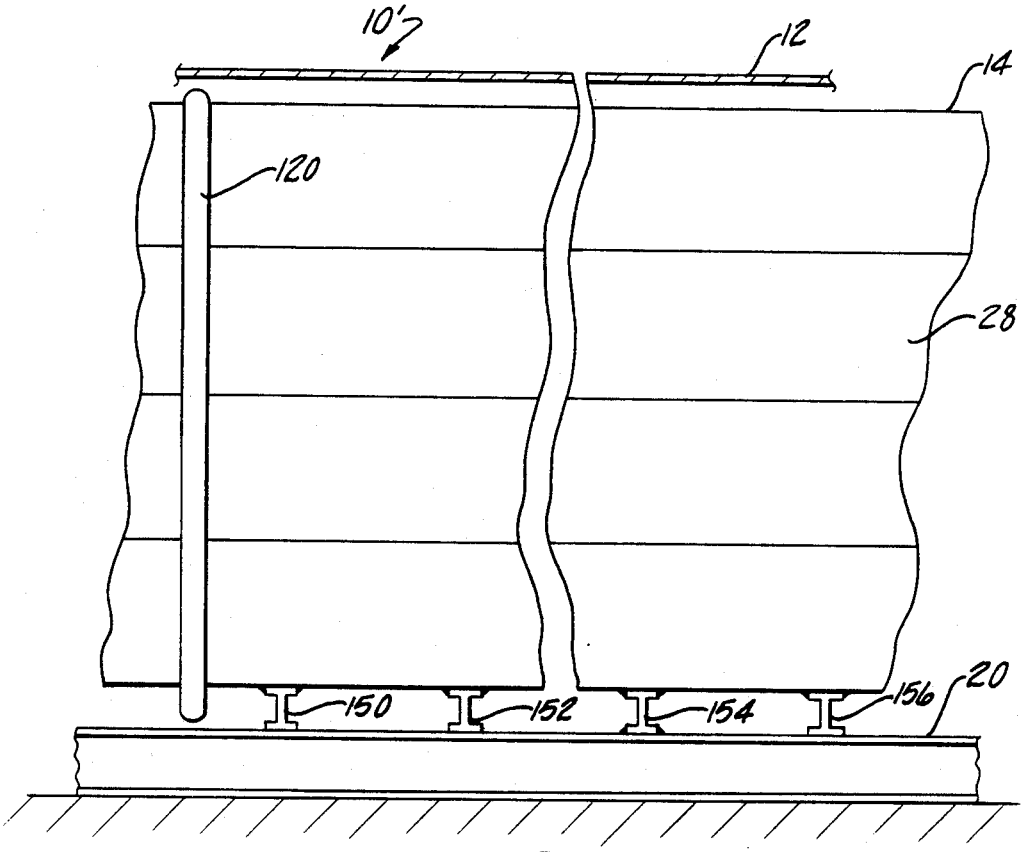
FIG. 10 is a partial side view of an alternative embodiment of the invention.
Figure 11:
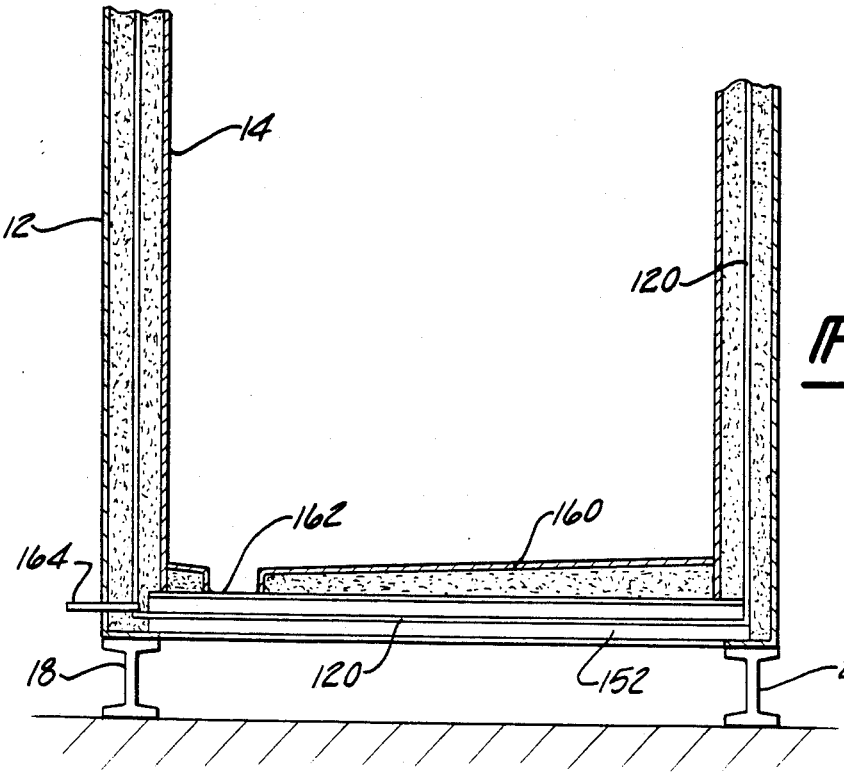
FIG. 11 is an end view in section of a still further embodiment of the invention.

Another similar and alternative construction is shown in FIGS. 10 and 11 where outer shell 12 is secured throughout its length (but not necessarily continuously) to longitudinal beams or rails 18 and 20 (only 20 is shown) and as before the floor of inner shell 14 is welded or otherwise rigidly connected to spaced, parallel cross beams 150, 152, 154 and 156; beam 154 is located substantially at the center of the module 10' shown. Inner shell 14 is spaced from outer shell 12 to allow for insulation (not shown).

Beams or rails 18,20 may be provided at the construction site as part of the foundation or they may be brought with the module 10', the former being preferred. Only cross beam 154 is fixed by welding or bolts or other conventional means to the longitudinal rails 18 and 20, all of the other cross beams 150, 152 and 156 being allowed to slide over rails 18 and 20 as necessary to accommodate thermal expansion. Again, the common concept with the embodiment of FIGS. 1-9 is to tie the inner and outer shells 14 and 12 together and to an external support at a single common point along the length of each module, allowing the two units to move longitudinally relative to one another over the balance of their lengths. As before, expansion joints 120 provide differential expansion freedom as between modules while tying them together with final, common unit.

FIG. 11 illustrates a further refinement of the invention, useful in any and all of the specific embodiments already described, to enhance the washdown process.

As in the previous embodiment, outer shell 12 is seated on and connected to longitudinal rails 18 and 20, and is spaced from inner shell 14 to allow for the expansion joint 120, which runs entirely around the periphery of each module connection joint, and for insulation as shown. The inner shell 14 rests on cross beams 152 and may be rigidly fixed thereto in the previously-described embodiment where beams 152 slide on rails 18 and 20. The inner shell 14 has on the interior thereof a false floor 160 which slopes from both sides toward a laterally-offset, longitudinally-running drain trough 162 for the purpose of collecting wash water and conveying it longitudinally to the next adjacent lower expansion joint portion 120. Since this expansion joint portion 120 is concave when viewed from inside the structure, and is lower than the trough 162, it may be used as a collector to convey the wash water laterally to a drain pipe 164. As before, the shells or boxes 12 and 14 need not be square or rectangular in section.

We claim:

1. An oven comprising:

a plurality of longitudinally extending oven modules positioned in end-to-end relation;

each of said modules having an outer shell and an inner shell and insulating material disposed between said shells;

at least one of said modules having a roof panel including self-releasing connector means for joining said panel to said one module;

said connector means including inner connecting elements adapted to engage inner fastening elements disposed on the inner shell of said one module and outer connecting elements adapted to engage outer fastening elements disposed on the outer shell of said one module;

said respective connecting elements and fastening elements having a configuration to permit self-releasing disengagement upon a sudden increase in pressure within said oven and to thereby allow separation of said panel from said one module without substantial damage to said one module;

said connector means also including a seal between said panel and said one module; and said connecting elements and fastening elements forming movable joints to permit relative movement between said panel and said one module due to thermal expansion and contraction.

2. The oven of claim 1 wherein said inner connecting elements are positioned to pass between said outer fastening elements as said roof panel disengages from said one module.

3. The oven of claim 1 wherein said inner connecting elements comprise upstanding flanges with inverted U-shaped members and said outer connecting elements comprise depending generally flat flanges; and wherein said inner fastening elements comprise upstanding generally flat flanges adapted for receipt within said inverted U-shaped members, and said outer fastening elements comprise depending flanges with U-shaped members adapted to receive said depending flat flanges.

* * * * *